United States Patent [19]

Jarosz et al.

[11] 4,427,963

[45] Jan. 24, 1984

[54] BRAKE AND OPERATION INDICATOR FOR A HIGH-VOLTAGE SWITCH

[75] Inventors: John M. Jarosz, Skokie; William R. Panas, Glenview, both of Ill.

[73] Assignee: S & C Electric Company, Chicago, Ill.

[21] Appl. No.: 437,925

[22] Filed: Nov. 1, 1982

[51] Int. Cl.[3] ..... H01H 85/00

[52] U.S. Cl. ..... 337/6; 337/241; 337/244

[58] Field of Search ..... 337/6, 143, 148, 206, 337/241, 244, 249, 248

[56] References Cited

U.S. PATENT DOCUMENTS 3,412,356 11/1968 Van Horssen ..... 337/148 X 4,103,270 7/1978 Jackson ..... 337/248 X

*Primary Examiner*—George Harris

*Attorney, Agent, or Firm*—John D. Kaufmann

[57] ABSTRACT

A brake and operation indicator for a movable contact of a switch, the movable contact being rapidly moved by ignition of a power cartridge to open the switch. A thin-walled sleeve is positioned conformally about a movable pin, a portion of which is lightly held in a bore of an end member of a housing for the switch. The sleeve is shorter than the distance between a head on the pin and the end member. The bore is normally closed by a thin membrane. When the contact is moved, it ultimately abuts the head, moving the pin through the membrane to a position beyond the end member where a portion of the pin is visible. Movement of the pin also collapses the sleeve between the head and the end member in accordion-like fashion to dissipate the kinetic energy of and stop the contact. The presence of the pin within the sleeve renders the collapse controlled, uniform, and efficient. The visible portion of the pin informs that the switch is open.

20 Claims, 2 Drawing Figures

BRAKE AND OPERATION INDICATOR FOR A HIGH-VOLTAGE SWITCH

BACKGROUND OF THE INVENTION

1. Field of the Invention

The present invention relates to a brake and operation indicator for a high-voltage switch and, more specifically, to apparatus which absorbs and dissipates the kinetic energy of a moving contact of a power-cartridge-operated high-voltage switch, while giving an indication that the switch has opened. Concurrently with giving an indication that the switch has opened, the pin may also initiate the operation of associated devices in response to the opening of the switch. The present invention constitutes an improvement of the apparatus described and claimed in commonly assigned U.S. Pat. No. 4,342,978 issued Aug. 3, 1982 in the name of Meister, and the following commonly assigned U.S. patent applications: Ser. No. 188,660, filed Sept. 19, 1980 now U.S. Pat. No. 4,370,531 in the name of Tobin; Ser. No. 179,367, filed Aug. 8, 1980 in the names of Jarosz and Panas; and Ser. No. 179,366, filed Aug. 18, 1980 in the name of O'Leary.

2. Discussion of the Prior Art

U.S. Pat. No. 4,342,978 discloses and claims an interrupting module of a current-limiting fuse having a high continuous current rating. The interrupting module comprises a more or less typical current-limiting section, which includes a spirally wound fusible element embedded in a compacted mass of a fulgurite-forming medium, such as silica-sand. An insulative housing is filled with the sand and surrounds the fusible element. Also within the housing is a normally closed switch. The switch includes a pair of contacts which are relatively movable apart along a fixed line of direction for opening thereof. Each end of the fusible element is electrically connected to one of the contacts, which are, in turn, electrically continuous with end terminals carried by the housing and by which the module is connected to a high-voltage electrical circuit for protection thereof. The impedance of the electrical path through the switch is substantially less than the impedance of the path through the fusible element so that, with the switch normally closed and with the module connected to the protected circuit, the majority of the current in the protected circuit flows through the switch, and not through the fusible element. When a fault current, or other over-current, is detected by sensing facilities, a power cartridge is ignited. Ignition of the power cartridge pressurizes a chamber defined by one of the contacts and by a trailer or piston carried by the other contact, which is movable away from the one contact.

The increase in pressure within the chamber rapidly moves the trailer and the movable contact carrying it away from the one contact to open the switch, thereby rapidly commutating the fault current in the switch to the fusible element, which interrupts the current in a more or less typical fashion. During movement apart of the contacts, the trailer isolates the widening gap between the contacts and the movable contact from the ignition products of the power cartridge which may be conductive. This isolation inhibits or prevents arcing between the separating contacts. Further, in the event any arc does form between the contacts, the trailer moves through a bore within, and co-acts with, an insulative tube or liner for constricting such arc. The trailer and the tube may be made of an arc-extinguishing material which, when subjected to the high heat of an electrical arc, evolves large quantities of cooling, de-ionizing, and turbulent gases, which along with arc constriction are effective to extinguish any arc which forms.

The above-noted commonly assigned U.S. patent applications describe and claim various aspects and improvements of the current-limiting fuse of the '978 patent. The '978 patent and the co-pending U.S. patent applications have in common the separation of switch contacts due to the ignition of a power cartridge or operation of a similar device. The movement of the contact due to ignition of the power cartridge is very rapid and ultimately results in there being imparted to the moving contact a large amount of kinetic energy. It is desirable that the housing for the interrupting module remain integral before, during and after its operation, and, accordingly, it has been determined that some way of bringing the moving contact to a stop without rendering the housing disintegral is desirable. Preferably, stopping the moving contact after it has sufficiently separated from the other contact to open the switch is achieved gradually with a gradual dissipation of its kinetic energy.

It has also been determined to be desirable to provide an indication that the switch of the interrupting module has opened. Since the module, including the fusible element and the switch, are contained within the housing, which is opaque, and cannot be directly observed, it is necessary to provide a visual or other detectable member external to the housing which indicates that the switch has opened. Further, in some use environments it may be desirable that this indicator have the capability of initiating the operation of other devices in response to the opening of the switch.

The present invention relates to the provision of apparatus for both braking and stopping the movable contact of the switch and for giving a visual indication that the switch has opened. The present invention is also concerned with the provision of such apparatus having low cost and simple construction combined with reliable operation. The provision of apparatus to achieve these ends is a main object of the present invention.

SUMMARY OF THE INVENTION

With the above and other objects in view, the present invention contemplates apparatus for braking and stopping the moving contact of a pressure-operated switch and for providing a visual indication that the switch has opened. The switch is of the type which includes a first moving contact and a second contact normally electrically interconnected with the first contact when the switch is closed. The switch also includes a pressure-generating facility for rapidly moving the first contact away from the second contact along a fixed line of direction. In specific embodiments, the pressure-generating facility is an ignitable power cartridge. Movement of the first contact away from the second contact opens the switch by breaking the normal electrical interconnection between the contacts and occurs in response to an event, such as ignition of the power cartridge, which occurs, in turn, in response to a fault current or other over-current in a circuit in which the switch is contained. The switch is contained within a housing, which includes an end member, enclosing it. The end member intersects the line of movement, and the first contact moves toward the end member as the switch opens.

The apparatus of the invention includes a collapsible, hollow, elongated, cylindrical sleeve oriented so that the major axis thereof coincides with the line of direction. An elongated, cylindrical two-position pin is conformally and axially slidably movable within, and mounts, the sleeve so that its major axis coincides with the line of direction. In its first position, the pin resides within the housing and is not visually observable. In its second position, the pin resides partially beyond the end member and outside of the housing and is, accordingly, visually observable. The pin includes a force-receiving site on an end thereof, against which the rapidly moving second contact abuts as the switch opens. This abutment moves the pin from its first positon to its second position, thereby giving a visual indication that the switch is open. Simultaneously with the movement of the pin from its first to its second position, the abutment of the first contact against the force-receiving site collapses the sleeve in accordian fashion to thereby dissipate the kinetic energy of the first contact. Dissipation of the kinetic energy brakes and stops the first contact. The presence of the pin within the sleeve as the sleeve collapses results in such collapse occurring in a controlled manner with the pleats of the collapsing and collapsed sleeve being constrained by the pin to reside on the outside thereof in a more or less regular configuration. This controlled braking and stopping of the first contact prevents the first contact from exiting the housing and prevents disintegration of or other damage to the housing. In its second position, the pin may, beside giving a visual indication that the switch is open, operate other apparatus.

DETAILED DESCRIPTION

Figure 1:
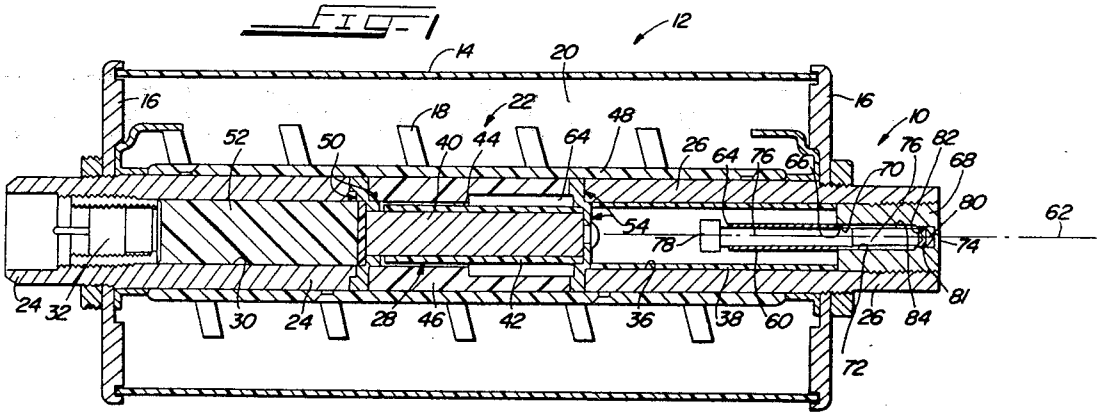
FIG. 1 is a partially sectioned, side elevation of a current-limiting interrupting module which depicts the braking, stopping and indicating apparatus of the present invention in its normal condition.

The present invention relates to braking, stopping, and indicating apparatus 10 for use with a current-limiting interrupting module 12. Because the module 12 is more completely described in the above-referenced commonly assigned United States patent and patent applications, it is only generally depicted in the drawing hereof and only generally described herein.

The module 12 includes a generally cylindrical open-ended insulative housing 14, which is closed by end plates 16. The closed housing 14 surrounds a current-limiting fusible element 18 helically wound around a central axis of the housing 14 and a mass of a particulate, fulgurite-forming medium 20, such as silica sand. The silica sand 20 is in intimate engagement with the fusible element 18. The fusible element 18, which may be a silver or copper, and the sand 20 interrupt fault currents or other over-currents therethrough in a current-limiting or energy-limiting manner, according to well-known principles. The fusible element 18 may be similar to those disclosed in commonly assigned U.S. patent applications, Ser. No. 194,712, filed Oct. 6, 1980 and Ser. No. 437,776, filed Oct. 29, 1982, both in the names of Jarosz and Panas.

The housing 14 also surrounds a switch 22 around which the fusible element 18 may be maintained in its helical configuration by a support (not shown), such as that disclosed in commonly assigned U.S. patent application, Ser. No. 181,603, filed Aug. 27, 1980 in the names of Jarosz and Panas. Although the switch 22 may have numerous constructions in accordance with the previously noted commonly assigned U.S. patent and patent applications, an exemplary embodiment is depicted in FIG. 1. Specifically, the switch 22 includes a first conductive member 24 which is stationarily mounted to the left end plate 16 and a second conductive member 26 which is stationarily mounted to the right end plate 16. The first conductive member 24 serves as a stationary contact of the switch 22, while the second conductive member 26 serves as a stationary terminal of the switch 22. The ends of the fusible element 18 are electrically connected with the conductive members 24 and 26 by facilities not described herein.

The switch 22 also includes a movable contact 28. Normally, the movable contact 28 is electrically continuous with both conductive members 24 and 26 so that a continuous low-resistance electrical path is formed between the members 24 and 26 via the movable contact 28. Because the resistance of this path is lower than the resistance of the fusible element 18, while the switch 22 is closed, as depicted in FIG. 1, the majority of the current flowing through the module 12 is normally shunted by the switch 22 away from the fusible element 18. When the switch 22 opens, as described below, the current formerly flowing through the members 24 and 26 and the movable contact 28 is commutated to the fusible element 18 for interruption.

In specific embodiments, the first conductive member or stationary contact 24 may have a central bore 30. At the left end of the central bore 30, a power cartridge 32, or other pressure-generating device, is located. The second conductive member or stationary terminal 26 also contains a central bore 36. This bore 36 may be lined with an insulative sleeve 38, which may be made of an arc-extinguishing material, for a purpose described below.

The movable contact 28 comprises a cylindrical conductive member 40 surrounded by an insulative sleeve 42, which may be made of an arc-extinguishing material, having a purpose described below. The movable contact 28 is normally located centrally between the conductive members 24 and 26 and within the bore 44 of an insulative member or liner 46 centrally held between the conductive members 24 and 26. As described below, the insulative member 46 may be made of an arc-extinguishing material.

The conductive members 24 and 26 are maintained in an aligned relationship, and the liner 46 is held in place therebetween, by an insulative housing 48 which surrounds the conductive members 24 and 26 and is mounted thereto in any convenient manner. As shown in FIG. 1, the fusible element 18 of the module 12 may be helically maintained about the housing 48 by structure not shown in FIG. 1. This structure may comprise a pair of notched fins attached to the housing 48, as described in commonly assigned co-pending U.S. patent application, Ser. No. 181,603, filed Aug. 27, 1980 in the names of Jarosz and Panas.

With the movable contact 28 occupying the position shown in FIG. 1, the conductive member 40 thereof is electrically interconnected to the conductive member 24 by a conductive diaphragm 50 or other metallic member, which is shearable, tearable or the like. To the left of the diaphragm 50, the conductive member 40 carries an insulative trailer or piston 52, which may be made of an arc-extinguishing material. In the normal position of the movable contact 28 shown in FIG. 1, the trailer 52 normally occupies the central bore 30 of the first conductive member 24.

The right end of the conductive member 40 is normally electrically interconnected to the second conductive member 26 by a diaphragm 54, which may be similar to the diaphragm 50. The interior of the insulative sleeve 38 is sufficiently large to conformally receive the conductive member 40 with its insulative sleeve 42 thereon. Further, the bore 44 of the liner 46 is sufficiently large to conformally receive both the conductive member 40 with the insulative sleeve 42 thereon and the trailer 52.

In the normal condition of the module 12, as shown in FIG. 1 and as previously described, the switch 22 carries all or a majority of the current flowing in a protected high-voltage circuit (not shown) to which the module 12 is connected. This current flows through the conductive members 24 and 26, the diaphragms 50 and 54, and the movable contact 28. Little or no current normally flows through the fusible element 18. Should a fault current or other over-current occur in the protected circuit (not shown) to which the fuse 12 is connected, apparatus (not shown) detects this condition and ignites the power cartridge 32. Ignition of the power cartridge 32 causes it to evolve large quantities of high-pressure gas which act on the left end of the trailer 52. The force applied to the trailer 52 by the high pressure rapidly moves the trailer 52 and the movable contact 28 (i.e., the conductive member 40 with the insulative sleeve 42 thereon) rightwardly. Rightward movement of the trailer 52 and of the movable contact 28 severs, rips or tears the diaphragms 50 and 54, thereby breaking the electrical interconnection between the movable contact 28, on the one hand, and both conductive members 24 and 26, on the other hand. Two gaps are thereby opened by the switch 22. The first gap exists between the left end of the conductive member 40, the right end of the first conductive member 24, while the second gap exists between the right end of the conductive member 40 and the left end of the second conductive member 26. Both gaps are insulated. Specifically, the first gap is insulated by the conformal reception of the trailer 52 within the bore 44 of the sleeve 46. The second gap is insulated by the conformal reception of the insulative sleeve 42 within the bore 44 of the insulative member 46. The conformal reception of the trailer 52 by the bore 44 of the insulative member 46 also isolates the movable contact 28 from the ignition products of the power cartridge 32, which may contain electrically conductive arc-promoting materials. If an arc should form between the first conductive member 24 and the conductive member 40, such arc must pass between the trailer 52 and the wall of the bore 44, which constricts the arc. Additionally, if such an arc is likely to form, the trailer 52 and the member 46 may be made of arc-extinguishing materials from which large quantities of cooling, deionizing, and turbulent arc-extinguishing gas will be evolved by the heat of the arc. All of these features either prevent formation of an arc between the first conductive member 24 and the movable contact 28 or, should such an arc form, ultimately extinguish it.

The conformal reception of the insulative sleeve 42 within the insulative sleeve 38 serves a similar function relative to preventing formation of an arc between the conductive member 40 and the second conductive member 26 or, should such an arc form, extinguishment thereof.

When the switch 22 opens, the current previously flowing therethrough is commutated to the fusible element 18. The action of the fusible element 18 and of the silica sand 20 ultimately extinguishes this current, as is well known.

As already described, ignition of the power cartridge 32 acts on the trailer 32 to move the movable contact 28 rightwardly. Such rightward movement of the movable contact 28 involves high kinetic energy being imparted thereto. Kinetic energy of about 150 joules has been calculated to be imparted to the movable contact 28 by the power cartridge 32. It is desirable that the movable contact 28 remain within the housing 14 and the end plate 16. Indeed, it is generally desirable that the before, during and after its operation, the module 12 remain wholly integral. The integrity of the module 12 and of its housing 14 and end plates 16 is particularly essential before operation of the module 12. Specifically, the housing 14 and the end plates 16 should remain integral and sealed together so that contaminants or the like do not enter the housing to adversely effect the operation of either the fusible element 18 or the switch 22. Also, during and after operation of the module 12 it is important that the housing 14 and the end plates 16 remain integral and sealed together to prevent portions of the module 12 from becoming potential missiles, which could damage or injure nearby property or persons, and to prevent the escape of hot, ionized gas which might adversely affect nearby high-voltage equipment. For these reasons, one goal of the present invention is the braking or slowing down and the ultimate stopping of the rapidly moving contact 28 following ignition of the power cartridge 32 in such a manner that the braking action is positive and controlled and that the movable contact 28 does not destroy the integrity of the housing 14 and the end plates 16. An additional objective of the apparatus 10 of the present invention is the giving of a visible indication that the switch 22 has opened and that the module 12 has thereby operated. Since the housing 14 and the end plates 16 are opaque, the internal elements of the module 12 are not visible.

As a consequence of both these desired ends, the apparatus 10 of the present invention provides for controlled and positive braking, slowing down, and ultimate stopping of the movable contact 28 and provides a visual indication that the module 12 has operated following opening of the switch 22, as described above. Moreover, the apparatus 10 is constructed so that, before the switch 22 operates, the sealed integrity of the housing 14 and of the end plates 16 is not compromised.

Referring to FIG. 1, the apparatus 10 of the present invention may be seen to include a thin walled, elongated, cylindrical metallic sleeve 60 having a major axis 62, which coincides with the fixed line of direction along which the movable contact 28 moves as the switch 22 opens. Thus, the left end 64 of the sleeve 60 lies on the path of the movable contact 28 and, more specifically, on the path of the right end of the conductive member 40 which, in the described embodiment, carries with it a portion of the diaphragm 54 after the switch 22 opens. The right end 66 of the sleeve 60 is adjacent to a plug 68, which may be threaded or otherwise inserted into a passageway 70 which is formed through the second conductive member 26 and which communicates with the interior of the sleeve 38.

The plug 68 contains a blind bore 72 therethrough. The right end of the blind bore 72 is normally closed by a thin membrane 74 or the like. Preferably, the plug is made out of a metal, such as brass, and the membrane 74 is integral therewith, being formed by milling or machining the blind bore 72 into the plug 68 until the membrane is approximately 0.015–0.030 inch thick.

Positioned partly within the interior of the sleeve 60 and partly within the blind bore 72 is an elongated, preferably metal pin 76. The pin 76 supports the sleeve 60. Although numerous possible constructions with the pin 76 are possible, a preferred construction is here described. Specifically, the left end of the pin 76 constitutes a force-receiving site and preferably takes the form of an enlarged head 78. Both the pin 76 and the head 78 have axes which are coincident with the major axis 62 of the sleeve 60 and with the fixed line of direction of the movable contact 28 as it moves rightwardly. Thus, the enlarged head 78 lies along the path taken by the movable contact 28 as it moves rightwardly following ignition of the power cartridge 32. Preferably, the length of the sleeve 60 is less than the distance between the head 78 and the plug 68. As a consequence, the sleeve 60, in effect, may ride on the pin 76 and is freely movable between positions defined by abutment of its ends 64 and 66 with the head 78 and the plug 68, respectively.

The right end of the pin 76 contains, or has formed thereon, a piercing tip 80. The piercing tip 80, which is configured so as to easily punch through or pierce the membrane 74 upon rightward movement of the pin 76, normally lightly rests against the interior surface of the membrane 74. In order to hold the pin 76 in its normal position, as depicted in FIG. 1, the outside of the pin 76 immediately to the left of the piercing tip 80 may be lightly knurled or roughened, as at 81, and the knurling may be lightly frictionally held by a diametrically smaller portion 82 of the blind bore 72. Other than the light, frictional engagement between the knurling 81 and the portion 82 of the blind bore 72, the pin 76 is preferably more or less loosely held within the interior of the sleeve 60 and within the blind bore 72 for free rightward movement thereof. Indeed, to ensure that the pin 76 is freely movable to the right following piercing of the membrane 74 by the piercing tip 80, the pin 76, between the knurling 81 and the enlarged head 78, may be undercut or decreased in diameter, as shown at 84, to ensure that the pin 76 does not engage the pierced edges of the membrane 74 after the piercing tip 80 passes therethrough. The reception of the pin 76 within the sleeve 60, while sufficiently loose to permit free rightward movement of the pin 76, is preferably conformal for a reason described immediately below.

With the module 12 in the condition shown in FIG. 1, the switch 22 is closed. The housing 14 and the end plates 16 are integral and sealed, and no free access to the interior of the module 12 is provided. In this vein, the membrane 74 normally closes the bore 72, preventing entry of contaminants, or the like, into the interior of the module 12 via the blind bore 72 and the interior of the sleeve 60.

Figure 2:
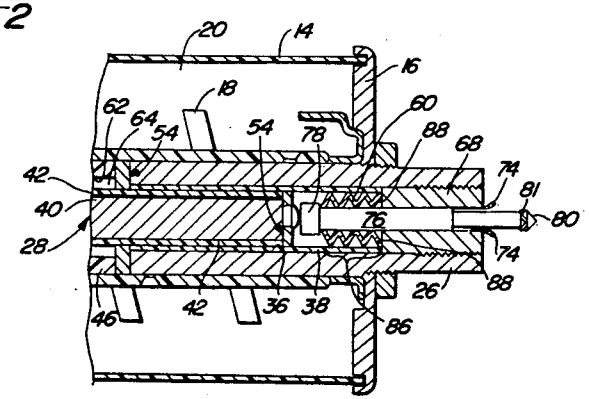
FIG. 2 illustrates a portion of the module of FIG. 1 and depicts the braking, stopping and indicating apparatus thereof following opening of a switch in the module.

Referring now to FIG. 2, the switch 22 is depicted at a time following some amount of movement of the movable contact 28 to the right, and at a time when the apparatus 10 of the present invention is achieving the ends sought thereby. Specifically, the movable contact 28 has moved sufficiently rightwardly to abut the enlarged head 78 of the pin 76. Following this abutment, the pin 76 is moved rightwardly to cause the piercing tip 82 to pierce the membrane 74 and to exit past the plug 68, where it thereafter is visually observable from the exterior of the housing 14 and the right end plate 16. In the normal position of the pin 76, either the enlarged head 76 is spaced a small amount from the left end 64 of the sleeve 60 (as shown in FIG. 1), or the right end 66 of the sleeve 60 is spaced from the plug 68, or both spacings exist. Accordingly and in any event, during the initial rightward of movement of the pin 76 immediately following abutment of the enlarged head 78 by the movable contact 28, only a small amount of force is required to move the knurling 81 through the smaller diameter portion 82 of the blind bore 72 and to cause the piercing tip 80 to pierce the membrane 74.

As the piercing tip 80 exits the pierced membrane 74, the enlarged head 78 contacts the left end 64 of the sleeve 60 and the right end 66 of the sleeve contacts the plug 68. Following these abutments, the still-high kinetic energy of the movable contact 28 causes the sleeve 60 to begin the collapse in accordian-like fashion. That is, as shown in FIG. 2, the sleeve 60 is collapsed into an accordian-like configuration 86 having a series of sinuous pleats 88. The presence of the pin 76 within the sleeve 60 as the pleats 88 are formed by the kinetic energy of the movable contact 28 causes the collapse of the sleeve 60 to occur in a controlled manner with the pleats 88 being constrained by the pin 76 to assure more or less even and uniform configurations on the outside of the pin 76. In effect, the pin 76, although moving rightwardly following the impact of the movable contact 28 against the enlarged head 78, acts as a forming mandrel for the collapsing sleeve 60. The energy expended in collapsing the sleeve 60 about the pin 76 dissipates the kinetic energy in the movable contact 28, thereby controllably braking the contact 28 and ultimately stopping it without permitting it to render the housing 14 or the right end plate 16 disintegral. At the same time, the exiting of the piercing tip 80 and the pin 76 beyond the pierced membrane 74 provides a readily observable visual indication that the switch 22 has opened and that the module 12 has operated. To this end, the piercing tip 80 or the portion of the pin 76 immediately to the left thereof may be painted a vivid color. As should be obvious, additional equipment external to the module 12 may be operated by the rightward movement of the pin 76.

When the sleeve 60 is fully collapsed, the head 78 abuts thereagainst. Because the head 78 is larger than the bore 72, the pin 76 cannot totally exit past the plug 68. Further, the non-undercut portion of the pin 76 now resides in the bore 72. The abutment of the head 78 against the collapsed sleeve 60 and the presence of the larger diameter portion of the pin 76 in the bore 72 effectively prevents any gas or item from exiting the bore 72.

In preferred embodiments, the sleeve 60 is made of steel, heat treated to provide a uniform, selected degree of softness. The sleeve 60 has a wall thickness of about 0.015 inch. It has been found that in an exemplary module 12 of the type illustrated in FIGS. 1 and 2 with a movable contact 28 having a mass of approximately 0.25 lb., the contact 28 impacts against the enlarged head 78 at a velocity of approximately 2000 inches per second (about 150 joules of kinetic energy), and the collapse of the sleeve 60 during 1 inch of travel of the contact 28 dissipates the kinetic energy of the contact 28 without deforming or rendering disintegral the right end plate 16 of the housing 14.

We claim:

1. Apparatus for braking and stopping a first moving contact of a switch and for indicating when the switch is open, the switch including a second contact normally electrically interconnected to the first contact when the switch is closed; the switch also including a pressure-generating facility for rapidly moving the first contact away from the second contact along a fixed line of direction to open the switch by breaking the normal electrical interconnection between the contacts in response to a selected condition; the switch being within a housing having an end member closing the housing and intersecting the line of movement; the first contact moving toward the end member as the switch opens; the apparatus comprising a collapsible, hollow, cylindrical sleeve oriented so that the major axis thereof coincides with the line of direction;

an elongated, cylindrical, two-position pin conformally within, axially slidable relative to, and mounting the sleeve so that the major axis thereof generally coincides with the line of direction, the pin residing within the housing and being not visually observable in its first position, the pin being visually observable and partially residing beyond the end member and outside of the housing in its second position; and a force-receiving site on an end of the pin against which the rapidly moving first contact abuts as the switch opens, such abutment moving the pin from its first position to its second position and simultaneously collapsing the sleeve in accordion-like fashion to thereby dissipate the kinetic energy of the first contact, the presence of the pin within the sleeve as the latter collapses resulting in such collapse occurring in a controlled manner with the pleats of the collapsing sleeve being constrained by the pin to be generally uniformly formed on the outside thereof.

2. Apparatus as in claim 1, wherein:

the pin in its first position is partially within the sleeve and partially within a bore formed in the end member, and the force-receiving site comprises an enlarged head on the end of the pin having a diametric size greater than the diameters of the sleeve and the bore, so that abutment of the first contact thereagainst effects abutment between the enlarged head and the sleeve and between the sleeve and the end member to cause the collapse thereof, and so that the pin cannot totally exit the bore.

3. Apparatus as in claim 2, wherein:

the distance between the enlarged head and the end member is greater than the length of the sleeve when the pin is in its first position so that a small amount of movement of the first contact and of the enlarged head abutted thereby occurs before collapse of the sleeve is initiated.

4. Apparatus as in claim 2, which further comprises a thin membrane normally closing the bore to seal the interior of the housing, and a membrane-piercing tip formed on an end of the pin opposite the enlarged head for piercing the membrane as the pin moves from its first position to its second position.

5. Apparatus as in claim 4, wherein:

the pin is loosely received within the bore so that substantially all of the braking and stopping of the first contact is effected by the collapse of the sleeve.

6. Apparatus as in claim 5, wherein:

the portion of the pin within the bore has a reduced diameter section so that movement of the pin to its second position is not inhibited by engagement between the pin and the pierced membrane.

7. Apparatus as in claim 6, wherein:

the tip normally abuts the membrane, and wherein the piercing tip lightly frictionally engages the wall of the bore adjacent the membrane to normally hold the pin in its first position.

8. Apparatus as in claim 7, wherein:

the distance between the enlarged head and the end member is greater than the length of the sleeve when the pin is in its first position so that, before collapse of the sleeve is initiated, an amount of movement of the first contact and of the enlarged head abutted thereby occurs which is sufficient for the tip to pierce the membrane.

9. Apparatus as in claim 1, wherein the distance between the force-receiving site and the end member is greater than the length of the sleeve when the pin is in its first position so that a small amount of movement of the first contact and of the site abutted thereby occurs before collapse of the sleeve is initiated.

10. Apparatus as in claim 1, which further comprises a thin membrane contiguous with the end member to seal the interior of the housing, and a member-piercing tip formed on an end of the pin opposite the force-receiving site for piercing the membrane as the pin moves from its first position to its second position.

11. Apparatus as in claim 10, wherein the pin in its first position is partially within the sleeve and partially within a bore formed in the end member, the bore being normally closed by the membrane.

12. Apparatus as in claim 11, wherein:

the pin is loosely received within the bore so that substantially all of the braking and stopping of the first contact is effected by the collapse of the sleeve.

13. Apparatus as in claim 12, wherein:

the portion of the pin within the bore has a reduced diameter section so that movement of the pin to its second position is not inhibited by engagement between the pin and the pierced membrane.

14. Apparatus as in claim 13, wherein:

the tip normally abuts the membrane, and wherein the piercing tip lightly frictionally engages the wall of the bore adjacent the membrane to normally hold the pin in its first position.

15. Apparatus as in claim 14, wherein:

the distance between the force-receiving site and the end member is greater than the length of the sleeve when the pin is in its first position so that, before collapse of the sleeve is initiated an amount of movement of the first contact and of the force-receiving site abutted thereby occurs which is sufficient for the tip to pierce the membrane.

16. Apparatus for braking and stopping a first moving contact of a switch and for indicating when the switch is open, the switch including a second contact normally electrically interconnected to the first contact when the switch is closed; the switch also including a pressure-generating facility for rapidly moving the first contact away from the second contact along a fixed line of direction to open the switch by breaking the normal electrical interconnection between the contacts in response to a selected condition; the switch being within a housing having an end member closing the housing and intersecting the line of movement; the first contact moving toward the end member as the switch opens; the apparatus comprising a collapsible, hollow, cylindrical sleeve oriented so that the major axis thereof coincides with the line of direction; and an elongated, cylindrical, two-position pin conformally within, axially slidable relative to, and mounting the sleeve so that the major axis thereof generally coincides with the line of direction, the pin residing within the housing and being not visually observable in its first position, one end of the pin being visually observable and partially residing beyond the end member and outside of the housing in the second position of the pin, the rapidly moving first contact abutting the other end of the pin as the switch opens, such abutment moving the pin from its first position to its second position and simultaneously collapsing the sleeve in accordion-like fashion to thereby dissipate the kinetic energy of the first contact, the presence of the pin within the sleeve as the latter collapses resulting in such collapse occurring in a controlled manner with the pleats of the collapsing sleeve being constrained by the pin to be generally uniformly formed on the outside thereof.

17. Apparaus as in claim 16, which further comprises means for preventing the pin from totally exiting beyond the end member in the second position of the pin.

18. Apparatus as in claim 17, which further comprises means for normally closing the end member, movement of the pin to its second position rendering the closing means disintegral.

19. Apparatus as in claim 18, which further comprises means for reclosing the end member after the closing means is rendered disintegral.

20. Apparatus as in claim 19, wherein the pin moves to its second position through a bore in the end member, the other end of the pin, the preventing means, and the reclosing means comprise an enlarged head against which the first contact abuts and between which and the end member the sleeve is collapsed, the head having a diametric size larger than the bore, and the closing means is a thin diaphragm normally closing the bore, the diaphragm being pierced by the pin as the pin moves to the second position.

* * * * *